United States Patent [19]

Holschlag

[11] 4,240,562

[45] Dec. 23, 1980

[54] GRAIN STORAGE BIN WALL PANEL

[76] Inventor: Richard C. Holschlag, R.R. 2, New Hampton, Iowa 50659

[21] Appl. No.: 25,780

[22] Filed: Apr. 2, 1979

[51] Int. Cl.[3] ..... B65D 6/32; B65D 6/38; B65D 8/12; B65D 8/22

[52] U.S. Cl. ..... 220/5 R; 220/5 A; 220/71; 220/72; 220/1 B

[58] Field of Search ..... 220/5 R, 1 B, 5 A, 71, 220/72

[56] References Cited

U.S. PATENT DOCUMENTS

| | | | |
|---|---|---|---|
| 932,243 | 8/1909 | Boll | 220/5 A |
| 1,076,382 | 10/1913 | Maloney | 220/5 A |
| 1,456,654 | 5/1923 | Strong | 220/5 A |
| 1,844,961 | 2/1932 | Kramer | 220/1 B |
| 1,875,666 | 9/1932 | Schwemlein | 220/5 A |

FOREIGN PATENT DOCUMENTS

| | | | |
|---|---|---|---|
| 447385 | 7/1927 | Fed. Rep. of Germany | 220/5 A |

*Primary Examiner*—George E. Lowrance
*Attorney, Agent, or Firm*—Zarley, McKee, Thomte, Voorhees & Sease

[57] ABSTRACT

A storage bin, comprising a plurality of sheet members comprised of deformable light gauge metal. The sheet members are generally of flat rectangular stock with a corrugation or brace means formed in one side. The sheet members are assembled in cylindrical tiers with the flat side portion of one sheet member spanning the interior of the corrugation on an adjacent sheet member to form a vertical brace. Additional tiers of sheet members are assembled with the vertical braces thereof aligning the vertical braces in the tiers below to create a plurality of continuous vertical brace members. The overlapping of the corrugation by the side edges of adjacent panel members creates an interior wall surface of the storage bin which is substantially smooth.

6 Claims, 6 Drawing Figures

GRAIN STORAGE BIN WALL PANEL

BACKGROUND OF THE INVENTION

This invention relates to grain storage bins and the like. Such bins have long been comprised of metal and often require vertical bracing to reinforce the otherwise light gauge metal used in the side walls thereof. Bins of the prior art vary in diameter and it is often necessary to have metal sheet members of different sizes and shapes to accommodate bins of different diameters.

Therefore, it is a principal object of this invention to provide a grain storage bin comprised of a plurality of substantially identical sheet members which can be used to create bins of varying diameters with the brace structures comprising an integral part of each sheet member.

SUMMARY OF THE INVENTION

The storage bin of this invention comprises a plurality of tiers of panel members of cylindrical shape wherein each panel or sheet member is identical in size and is substantially smooth except for a vertical corrugation formed in one side thereof. The vertical corrugation is overlapped by the adjacent panel or sheet member to provide a relatively smooth interior wall with a brace member being formed on the exterior wall. The braces of each tier are in vertical alignment to create substantially vertical brace members.

DESCRIPTION OF THE PREFERRED EMBODIMENT

Figure 1:
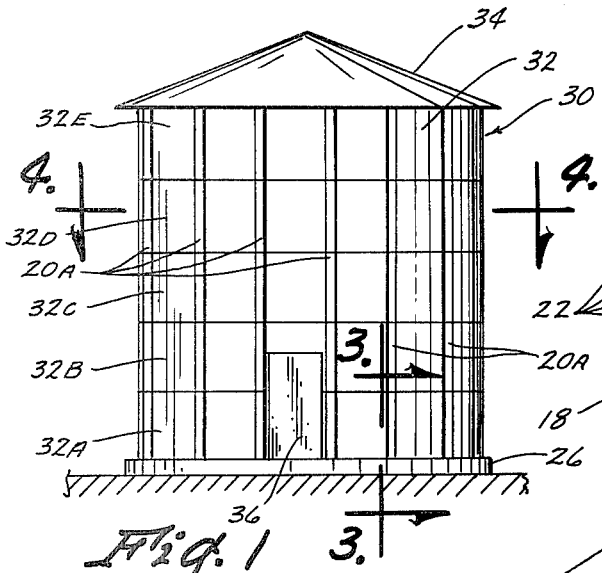
FIG. 1 is an elevational view of the grain storage bin made according to this invention.
Figure 2:
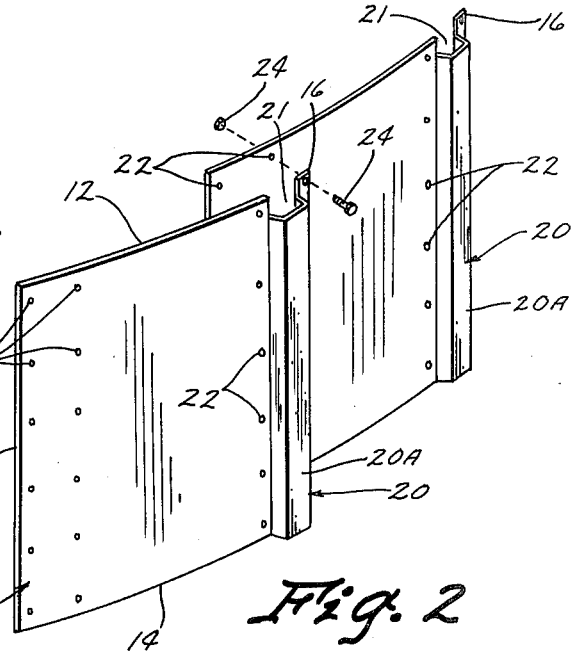
FIG. 2 is a perspective view at an enlarged scale of two panel members in disassembled condition.

The numeral 10 generally indicates the panel or sheet member used to construct the grain storge bin of this invention. The sheet member 10 has an upper edge 12, a lower edge 14, a first side edge 16, and a second side edge 18. The side edges are usually vertically disposed and the top and bottom edges are normally horizontally disposed. The sheet members 10 are generally of rectangular construction and conventionally are 24 inches wide and 36 inches high. The gauge of the metal used to make sheet members 10 can vary, but the metal should be of a flexible quality to permit the sheet member to be bent into any desired radius.

A corrugation 20 is formed adjacent the side edge 16 of sheet member 10 according to conventional procedures. The corrugation conventionally is approximately two inches deep and is usually wider than it is deep. The upper part of each corrugation is cut out at 21. The panel members 10 are assembled by causing the side edge 18 to span across the corrugation 20. Apertures 22 in the sheets are superimposed, and the sheets are secured together in conventional fashion by nut and bolt assemblies 24 which extend through registering apertures. The assembled sheets create a relatively smooth inner surface of the erected wall. The corrugation or brace 20 is normally positioned on the outer surface of the wall to be erected. Sheet members 18 are deformed to the desired radius required by the design of the bin in construction.

Figure 3:
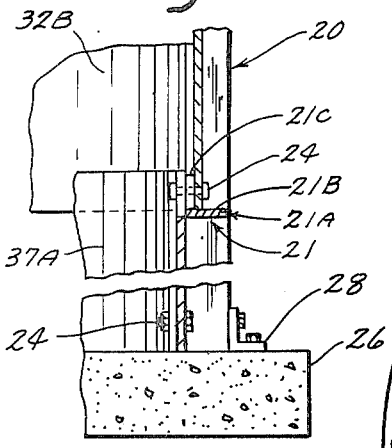
FIG. 3 is a partial sectional view at an enlarged scale taken on line 3—3 of FIG. 1 and showing the manner in which the wall portion is secured to the foundation or floor.
Figure 6:
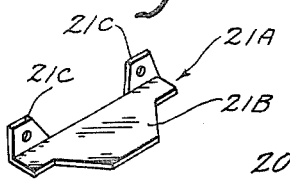
FIG. 6 is a perspective view of a brace clip.
Figure 4:
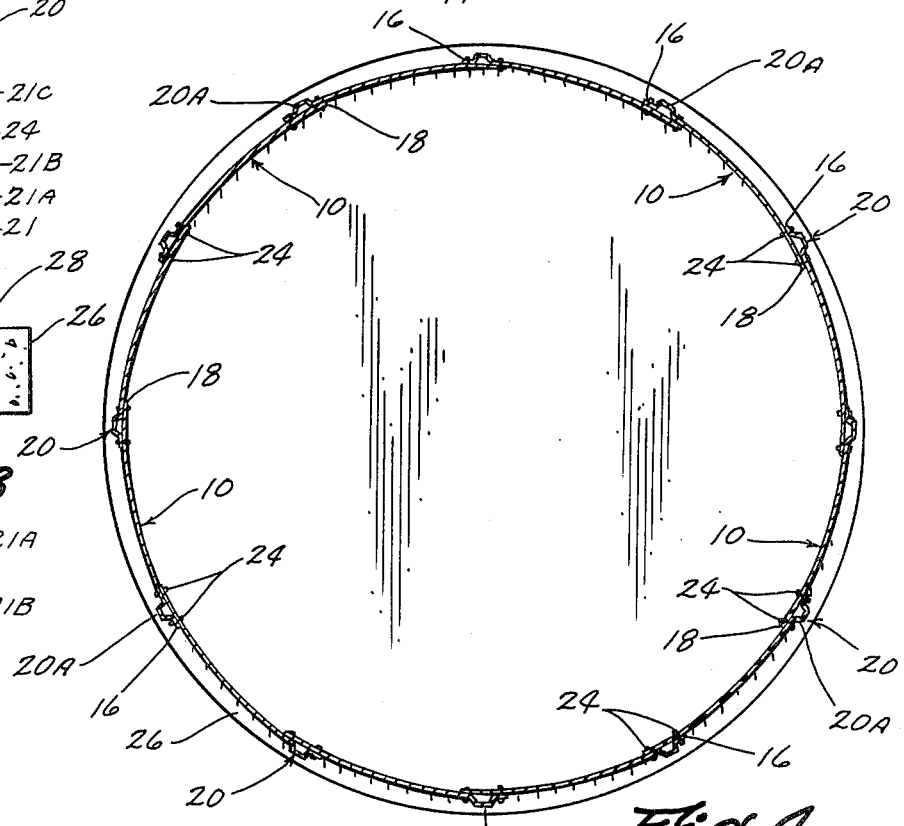
FIG. 4 is a sectional view taken at an enlarged scale on line 4—4 of FIG. 1.
Figure 5:
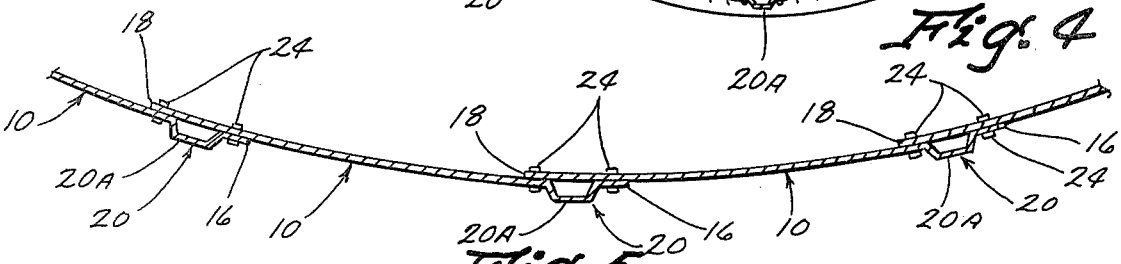
FIG. 5 is a sectional view taken at an enlarged scale through a bin made according to this invention.

FIG. 1 shows an erected grain storage bin comprised of a horizontal floor 26. Conventional brackets 28 are used to secure the braces 20 of the sheet members 10 to the floor 26. The erected bin 30 has a cylindrical wall surface 32 with a relatively smooth inner surface 32*a*. A conventional roof structure 34 is mounted on the top of the cylindrical wall 32. The wall 32 is comprised of a plurality of tiers 32*a*, 32*b*, 32*c*, 32*d*, and 32*e* of assembled sheet members 10. The braces 20 of each tier are aligned with the braces of the tiers below so as to create a plurality of substantially continuous vertical braces 20A. A brace clip 21A comprising a horizontal shelf 21B and a pair of upstanding tabs 21C is positioned on top of each cut out portion 21 (FIGS. 3 & 6). Clips 21A support the corrugations or braces of the sheets in the tiers immediately above. Nut and bolt assemblies extend through the sheets and tabs 21C. Shelf 21B is preferably slightly larger than the cross-section of the corrugations 20. Special framing, not shown, can be used to create a door opening 36.

From the foregoing, it can be seen that bin structures of varying diameters can be constructed from a single inventory of sheet members 10 merely by varying the diameter to which each sheet member is bent. The braces 20*a* created by the assembled tiers of panel members creates a strong and rigid wall structure.

From the foregoing, it is seen that this invention will therefore achieve all of its stated objectives.

What is claimed is:

1. A grain storage bin or the like, comprising, a horizontal floor means, a cylindrical wall means having inside and outside surfaces on said floor means, said wall means comprising a plurality of sheet members of generally rectangular configuration having top, bottom, and first and second vertical side edges, a vertical corrugation formed in each sheet member adjacent said first sides edge thereof to form a vertical brace, the remainder of each of said sheet members being substantially smooth except for said corrugation, the vertical brace of each sheet member being superimposed over and outside the second side edge of the laterally adjacent sheet member to place said brace on the outside surface of said wall means, said second side edge completely spanning said corrugation of the laterally adjacent sheet member to create a substantially smooth surface at the inner surface of said wall means, fastener means for securing each sheet member to the second side edge of the laterally adjacent sheet member, said fastener means being arranged adjacent said vertical brace on opposite lateral sides thereof and vertically positioned from adjacent said top edge to adjacent said bottom edge of each sheet member such that the second side edge of each sheet member cooperates with the vertical brace superimposed thereover to form a generally rigid tubular structural member, said wall means further comprising a plurality of tiers of said sheet members with the corrugations of each tier being in substantial vertical alignment with the corrugations of the other tiers to create substantially continuous vertical braces.

2. The device of claim 1 wherein the bottom edges of the sheet members in each upper tier extend over the outside of the upper edges of the sheet members in the tier immediately thereunder.

3. The device of claim 1 wherein substantially all of said sheet members are identical in size.

4. The device of claim 1 wherein at least some of said tiers being formed in a complete circle within said wall means.

5. A grain storage bin or the like, comprising, a horizontal floor means, a cylindrical wall means having inside and outside surfaces on said floor means, said wall means comprising a plurality of sheet members of generally rectangular configuration having top, bottom, and first and second vertical side edges, a vertical corrugation formed in each sheet member adjacent said first sides edge thereof to form a vertical brace, the remainder of each of said sheet members being substantially smooth except for said corrugation, the vertical brace of each sheet member being superimposed over and outside the second side edge of the laterally adjacent sheet member to place said brace on the outside surface of said wall means, said second side edge completely spanning said corrugation of the laterally adjacent sheet member to create a substantially smooth surface at the inner surface of said wall means, said wall means further comprising a plurality of tiers of said sheet members with the corrugations of each tier being in substantial vertical alignment with the corrugations of the other tiers to create substantially continuous vertical braces, the upper portion of each corrugation being cut out to form an edge portion in a horizontal plane, and a clip means on said edge portion to form a bearing surface, the corrugation in the sheets in the upper tiers resting on said clip means.

6. The device of claim 5 wherein said clip means includes a shelf portion which extends over said edge portion.

* * * * *